US009451819B2

(12) United States Patent
Mathews, Jr.

(10) Patent No.: US 9,451,819 B2
(45) Date of Patent: Sep. 27, 2016

(54) TOOL CINCH WITH STABILIZING WINGS

(71) Applicant: Python Safety, LLC, Woodstock, GA (US)

(72) Inventor: William J. Mathews, Jr., Woodstock, GA (US)

(73) Assignee: Python Safety, LLC, Woodstock, GA (US)

( * ) Notice: Subject to any disclaimer, the term of this patent is extended or adjusted under 35 U.S.C. 154(b) by 73 days.

(21) Appl. No.: 14/251,953

(22) Filed: Apr. 14, 2014

(65) Prior Publication Data

US 2014/0304952 A1 Oct. 16, 2014

Related U.S. Application Data

(60) Provisional application No. 61/811,272, filed on Apr. 12, 2013.

(51) Int. Cl.

| | |
|---|---|
| ***A45F 5/00*** | (2006.01) |
| ***A45F 5/02*** | (2006.01) |
| ***A45F 3/14*** | (2006.01) |

(52) U.S. Cl.

CPC . *A45F 5/00* (2013.01); *A45F 3/14* (2013.01); *A45F 5/021* (2013.01); *A45F 2003/142* (2013.01); *A45F 2005/006* (2013.01); *A45F 2200/0575* (2013.01); *Y10T 24/318* (2015.01); *Y10T 29/49826* (2015.01)

(58) Field of Classification Search

None

See application file for complete search history.

(56) References Cited

U.S. PATENT DOCUMENTS 5,535,928 A * 7/1996 Herring ..... A45F 5/021 224/250

6,000,591 A * 12/1999 Alexander ..... A45F 3/14 211/113

* cited by examiner

*Primary Examiner* — Jack W Lavinder

(74) *Attorney, Agent, or Firm* — Dicke, Billig & Czaja, PLLC

(57) ABSTRACT

A tool cinch is provided for securement to a tool, the cinch then being connectable to a lanyard for preventing the tool from falling if dropped before, during, or after use. The cinch includes radially projecting wings that are secured to the tool with tape or the like to further buttress securement of the tool.

14 Claims, 2 Drawing Sheets

TOOL CINCH WITH STABILIZING WINGS

CROSS-REFERENCE TO RELATED APPLICATIONS

This application claims the benefit of U.S. provisional patent application Ser. No. 61/811,272, filed Apr. 12, 2013, which is incorporated herein by reference in its entirety.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND

The present device is in the field of dropped object prevention. More particularly, the present device is in the field of creating attachment points on tools to prevent dropped objects.

Most tools in use for construction and maintenance have either a hole or other relatively easy way of creating an attachment point. However, there are various tools on which it is difficult to create an attachment point due to their straight nature, slightly tapered handle, closed handle, or lack of handle, such as pinch bars, pry bars, digging bars, torque wrenches, breaker bar ratchets, clamps, larger spanner wrenches, larger open end wrenches, larger box style wrenches, larger combination wrenches, larger open end wrenches, sledge hammers, power tools with triggers, such as drills and saws, and other tools.

In the past, simple cinches have been used in an effort to prevent a dropped tool from falling and damaging something or injuring someone below the work site. With such a cinch, a strap is utilized, having a closed ring at one end and a loop at the other. The ring end is passed through the closed loop, or the like and pulled tight. The tool is secured in the loop that is formed by the ring end passing through the closed loop. Regardless of how tight the cinch is pulled, it is prone to loosening as the tool is being used, which can result in the tool slipping through the cinch. Subsequently, if the tool is dropped with the cinch compromised, the tool may be damaged, or it may cause injury to objects or persons below the work site. While additional measures can and have been employed, i.e., tying knots, taping the cinch loop to the tool, even these do not provide the requisite security.

It is to the above disadvantages and shortcomings of the prior art that the present disclosure is directed.

SUMMARY

The present device is an attachment point for dropped object prevention primarily for tools where conventional attachment points are not available, although it can be used on tools that do have attachment points. The tool cinch assembly uses a strap with a loop on one end, and a ring or the like on the other, and extended webbing or other material in the form of radially extending wings, combined with a securing means, such as tape, to wrap around the tool and the wings. The wings allow for positioning the device in the proper location on the tool, and holding it there with tape or like means so the cinch strap does not become disconnected or slide off of the tool prior to or during the occurrence of a dropped object. This embodiment allows the cinch strap itself to utilize the energy created when the tool falls and snatches back to prevent the tool from falling to the ground or surface below. This embodiment of the device allows for the creation of an attachment point for tools weighing up to 35 lbs or more. V or D Rings at the other end of the strap act as an attachment point for securing the attachment to a lanyard, which prevents the tool from falling to the ground.

DETAILED DESCRIPTION

In the following detailed description of various embodiments of the present device, numerous specific details are set forth in order to provide a thorough understanding of various aspects of one or more embodiments of the device. However, one or more embodiments of the device may be practiced without these specific details. In other instances, well-known methods, procedures, and/or components have not been described in detail so as not to unnecessarily obscure aspects of embodiments of this device.

In the following description, certain terminology is used to describe certain features of one or more embodiments of the device. For instance, "pry bar" and "digging bar" refer to any of the numerous tools used by construction workers to apply leverage or create protrusions during the performance of their job.

Figure 1:
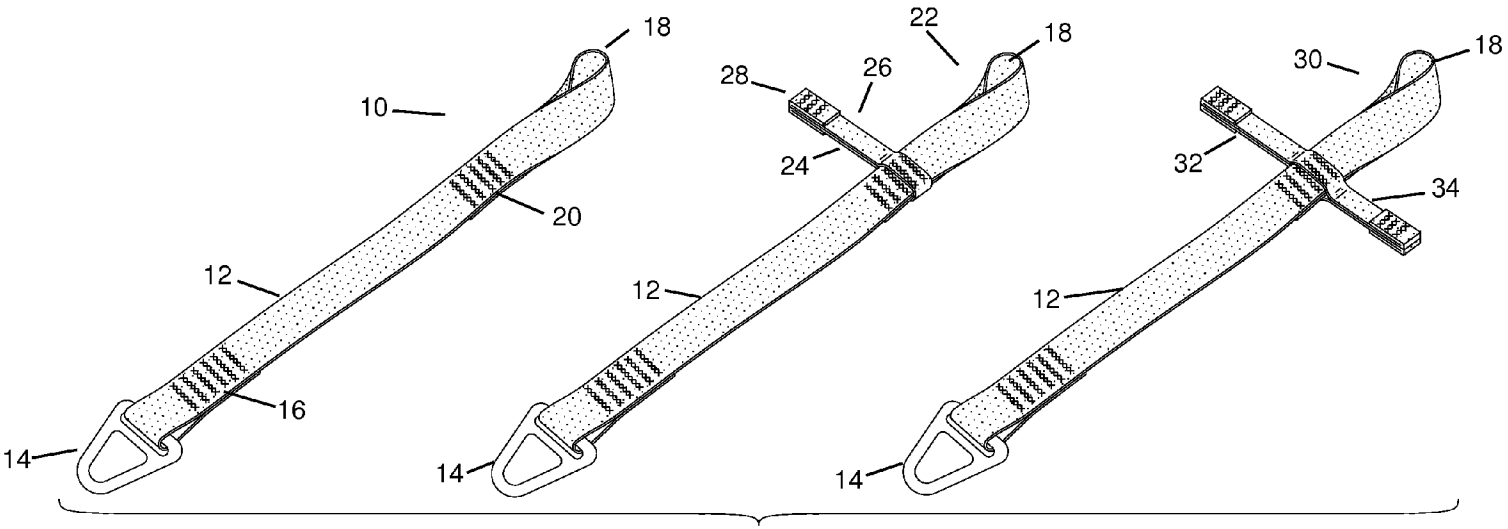
FIG. 1 is a perspective view of a prior art cinch and two different embodiments of the present cinch with stabilizer wings.

Referring now more specifically to the drawings, and to FIG. 1 in particular, numeral 10 designates generally a prior art tool cinch. The cinch has an elongated strap 12, which comprises the main body portion. At one end, a conventional V-ring 14 is secured by threading the end of the strap through the V-ring, or a portion thereof, and stitching the threaded end to the body, as shown at 16. At the other end, a loop is formed by first twisting the end of the strap, forming a loop 18, and then stitching the free end of the strap to the body, as shown at 20. The cinch is created by passing the V-ring 14 through the loop 18 and pulling the resulting loop tight against a portion of the tool to be secured.

Numeral 22 designates generally a first embodiment of the present tool cinch with a stabilizer. With like parts being referenced by like numerals, the present tool cinch 22 has a main body strap 12 with a V-ring 14 at one end and a loop 18 at the other. Secured to the strap 12, between the V-ring and the loop, is a stabilizer in the form of a radially projecting wing 24. The wing has one end secured to the strap 12 with stitching or other appropriate means.

The wing itself comprises a strap 26 having, as stated, one end secured to the main body portion of the cinch. The opposite end is folded over upon itself, once, twice, or more times, and stitched or otherwise secured to the strap portion of the wing to form an abutment in the form of a catch tab 28.

An alternate embodiment is shown in FIG. 1, the cinch being designated generally by numeral 30. This embodiment has a pair of wings 32 and 34. The wings are secured to the strap 12 of cinch 30 and project radially therefrom, in opposite directions. The wings 32 and 34 can be a single member, or can be two separate members. Securement to the cinch is as described in the previous embodiment and each distal end of the wings includes a catch tab, the use of which will be more fully described hereinafter.

Figure 2:
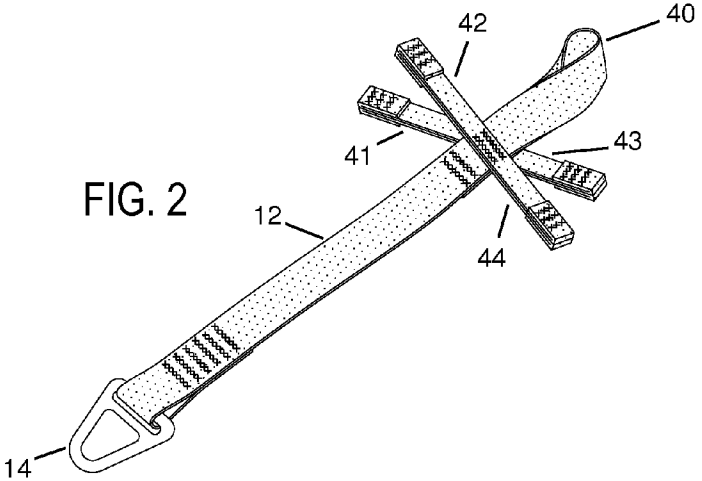
FIG. 2 is a perspective view of another embodiment of the present device.

Another embodiment of the present device is shown in FIG. 2. In this embodiment, the cinch 40 has a plurality of wings 41-44, each projecting radially from the main body portion, strap 12. Each of the wings is constructed and secured as described hereinabove. It should be noted that virtually any number of wings can be employed with the present device, and can be deployed at virtually any position on the cinch strap 12.

Figure 3:
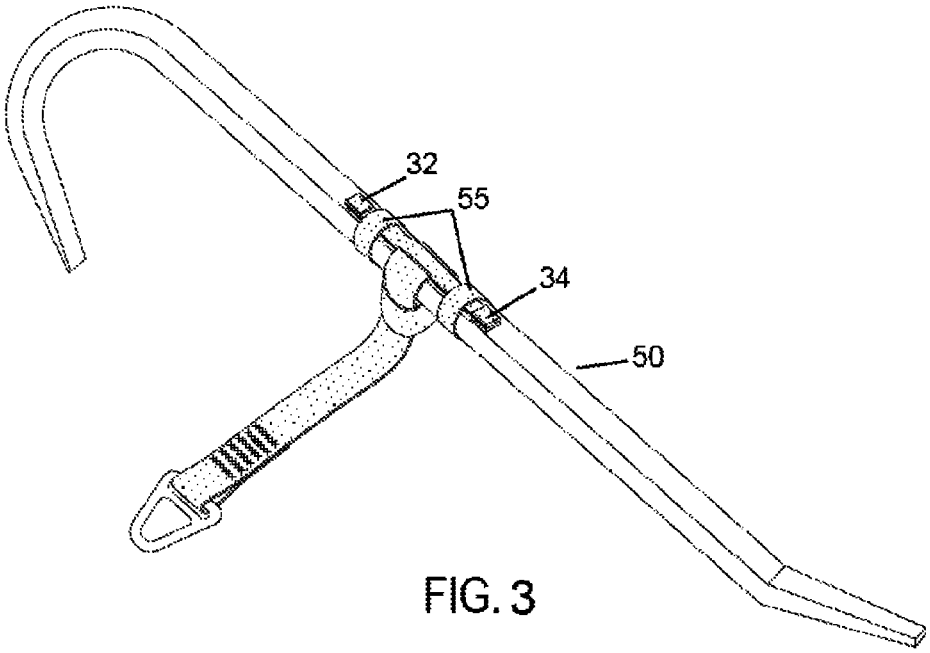
FIG. 3 is a perspective view of one embodiment of the present tool cinch assembly attached to a tool.
Figure 4:
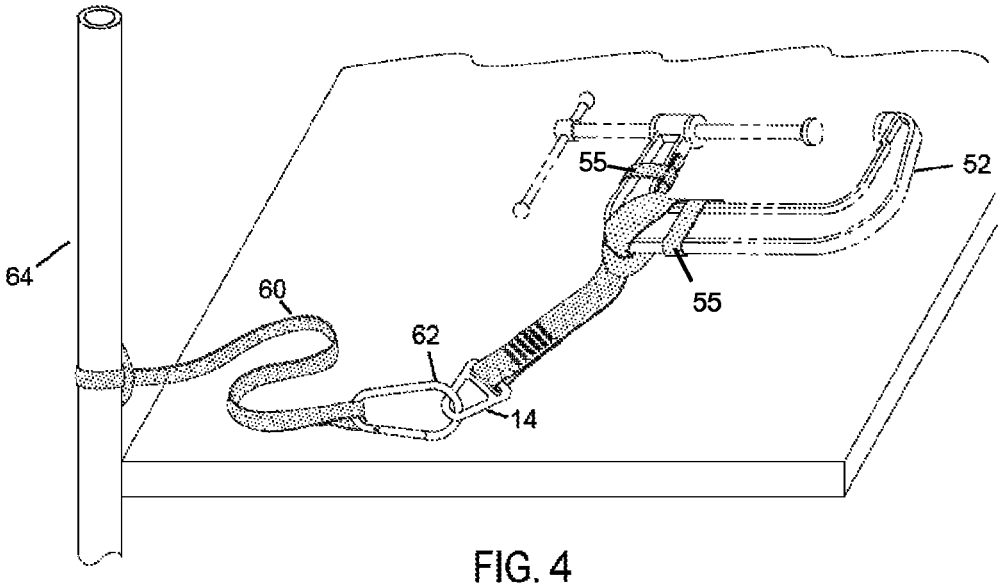
FIG. 4 is a perspective view illustrating details of attachment of the present device to a tool.

The present device is shown in use in FIGS. 3 and 4. In FIG. 3, the tool cinch assembly is shown secured to a pry bar 50, or wrecking bar, as it is often called, and in FIG. 4, the device is shown attached to a C-clamp 52. The exemplary illustration of FIG. 3 demonstrates how a long-standing problem is solved. In applying the prior art cinch to the wrecking bar, the extent of the securement is dependent on how tight the user can draw the cinch. During use, and if, in the interim, the bar is dropped, the cinch may tighten, but on the rebound, the cinch is prone to loosen. As a result, it is possible, and even likely, that the cinch will eventually slip off the bar and be dropped or simply fall, with adverse results for objects or persons below.

In applying the present cinch, the tool is first captured by the cinch. As shown in FIG. 3, the wings 32 and 34 are extended radially from the main body strap 12 and deployed parallel to, and in contact with, the body of the wrecking bar 50. A securing means, such as self-sealing tape 55, shrink wrap, or other medium, is then wrapped around the wings and the body of the wrecking bar. With the stabilizing wings deployed and secured, the cinch is prevented from slipping off of the tool, regardless of whether the cinch itself has loosened.

FIG. 4 illustrates the versatility of the present device. The wings are flexible and can be deployed in virtually any orientation, here shown deployed along a curved elbow of a C-clamp 52. The wings are extended adjacent to the curved surfaces of the C-clamp and secured thereto with tape, heat shrink, or the like. A lanyard 60, having a carabiner 62 or other like device at one end thereof, is secured to a fixed object, such as a scaffold pole 64, a ladder, a tool belt worn by a worker, or another object. The carabiner is secured to the V-ring 14. This arrangement effectively prevents the cinch from accidentally becoming detached from the tool. If the tool is inadvertently dropped, it is prevented from falling by the present device being secured to the tool and to the lanyard.

In the use and operation of the present device, the tool cinch portion, using the cinch itself, absorbs the dynamic load generated when a tool drops, and is further supported and strengthened by a protruding cross-sectional wing or wings which are held in place with either tape, heat shrink, both, or other means. The radially extending wing or wings are used to keep the cinch in place, as all dynamic load is captured at the cross section of the main cinch strap and the cross-wing or wings.

Many tools used at height are slightly tapered and/or do not have an end cap or other fixture on the end which would prevent normal chokes or cinching type products from simply sliding off the end of the tool. This is the problem this device is solving.

The wings with catch tabs are used in combination with quick wrap tape and/or with heat shrink links to hold the cinch mechanism in place. This creates a stationary cinch/choke mechanism, designed to prevent the attached tool from falling from an elevated work area when attached to an extension lanyard. The energy created at the point where the tool reaches the length of the extension lanyard creates a firm friction point, which consistently maintains control of the tool. During the recoil phase of a dropped object, the tool will spring back slightly and the cinch may tend to loosen. The attached wings secured with the quick wrap and/or heat shrink links prevent the apparatus from working its way off of the tethered tool.

The wing sizes for this apparatus can range from approximately 2" up to approximately 12" inches in length. The width of the wings range from approximately ½" to approximately 2" wide. Other sizes and lengths may also be utilized.

The wing material can be rope, woven or non-woven webbing such as nylon, polyester, vinyl, elastic, tubular or non-tubular webbing and other means. The wings have catch tabs sewn to the ends, which serve as catch points. The catch tabs provide an abutment which the securing means, such as tapes or heat shrink means, can bear against, thereby preventing the tapes, heat shrink means, or other securing means from possibly slipping off the wings. This additional level of security has not been utilized in the prior art and while other expedients have been tried, uncompromised security has not been attained until now.

The wings are secured with a variety of materials such as quick wrap tape and/or heat shrink links. Additionally, other tape materials, hook & loop fastening, and banding straps are also viable options, as well as other means. The wings are normally secured in a parallel orientation to the handle of the tool or along the main body portion of the tool. This provides maximum contact with the tool for added security. The wings normally project radially from the main cinch strap and are normally disposed perpendicular to the main cinch strap; however, other orientations are possible, such as angular, and are considered to be within the scope of the present disclosure. Similarly, the number of stabilizers can be varied from a device with a single stabilizer to ones having a plurality of stabilizers.

The cinch strap can be rope, woven or non-woven webbing such as nylon, polyester, vinyl, elastic, non-tubular webbing or tubular webbing with elastic cord or webbing sewn inside, creating a bungee style apparatus, and other means.

The loop at the top of the device is designed with a special twist to improve the gripping function of the device, as shown in FIG. 2. This simple modification assists the wings in preventing slippage during a scenario in which the tool being tethered is tapered or no end cap or other abutment is present.

The main strap is fed through the twisted loop allowing for use with multiple sizes, as the device is adjustable in circumference. This device is effective on tools ranging from approximately 1" to approximately 4" in diameter. The device can, of course, be made larger or smaller to accommodate tools of virtually any size. This is another useful feature of the device.

The D-Ring and V-Ring used on both devices are used for attaching lanyard extensions for securing the device, while attached to a tool, to a reliable structure, such as a scaffold, during use as shown in FIG. 4. This method extends the life of the device by reducing wear and tear to the attachment point and provides an additional level of security in preventing injuries from falling tools and/or other implements.

While an embodiment of a tool cinch and modifications thereof have been shown and described in detail herein, various additional changes and modifications may be made without departing from the scope of the present disclosure.

What is claimed is:

1. A tool cinch assembly for attachment to a tool having a first portion and a second portion and having added stabilization, comprising:

an elongated strap with a closed ring at one end thereof, a closed loop at the other end thereof, and at least one wing projecting radially from said strap, the closed loop configured and arranged to receive the closed ring and the elongated strap, wherein the closed ring is inserted through the closed loop and pulled therethrough to form a strap loop configured and arranged to secure said first portion of the tool; and a securing medium adapted to interconnect the at least one wing and said second portion of the tool.

2. A tool cinch assembly as defined in claim 1 and including an additional wing projecting radially from said strap.

3. A tool cinch assembly as defined in claim 2 in which said wings are disposed parallel to each other.

4. A tool cinch assembly as defined in claim 2 in which said wings project from said strap in opposite directions.

5. A tool cinch assembly as defined in claim 1 and including a plurality of additional wings projecting radially from said strap.

6. A tool cinch assembly as defined in claim 1 in which said wing projects angularly from said strap.

7. A method for preventing a tool cinch from becoming disconnected from a tool, the cinch having a main body portion, a loop at one end and a ring at the other end, the cinch further including at least one wing projecting radially from said main body portion, comprising the steps of:

a. capturing the tool with the cinch by threading the ring through the loop and around a portion of the tool;

b. placing the wing adjacent the tool; and c. wrapping tape around the tool and the wing.

8. A tool cinch assembly for attachment to a tool to prevent the tool from falling further than a lanyard attached to the assembly, comprising an elongated strap having a loop formed at one end thereof and a ring attached at the other end thereof, at least one wing attached to said strap and projecting radially therefrom, said strap being configurable into a cinch for encircling a portion of a tool, and a securing medium wrapped around said wing and a portion of the tool to maintain a connection of the cinch to the tool.

9. A tool cinch assembly as defined in claim 8 and including an additional wing secured to said strap and projecting radially therefrom.

10. A tool cinch assembly as defined in claim 9 in which said wings include catch tabs at their distal ends for preventing said securing medium from becoming disconnected from said wings.

11. A tool cinch assembly as defined in claim 8 in which said securing medium comprises self-sealing tape.

12. A tool cinch assembly as defined in claim 8 in which said securing medium comprises heat shrink material.

13. A tool cinch assembly as defined in claim 8 in which said wing includes a catch tab at the free end thereof for providing an abutment for containing said securing medium.

14. A method for preventing a tool cinch from becoming disconnected from a tool, the cinch having a main body portion, a loop at one end and a ring at the other end, the cinch further including at least one wing projecting radially from said main body portion, comprising:

capturing the tool with the cinch by threading the ring through the loop to form a resulting loop and cinching the resulting loop around a portion of the tool;

placing the wing adjacent the tool; and connecting the wing to the tool with a securing medium.

* * * * *